US009758995B2

(12) United States Patent
Kalsi et al.

(10) Patent No.: US 9,758,995 B2
(45) Date of Patent: Sep. 12, 2017

(54) LATCH BUFFER ASSEMBLY

(71) Applicants: Gurbinder Kalsi, Oldbury (GB); Mark Burditt, Leicestershire (GB)

(72) Inventors: Gurbinder Kalsi, Oldbury (GB); Mark Burditt, Leicestershire (GB)

(73) Assignee: INTEVA PRODUCTS, LLC, Troy, MI (US)

( * ) Notice: Subject to any disclaimer, the term of this patent is extended or adjusted under 35 U.S.C. 154(b) by 230 days.

(21) Appl. No.: 14/577,921

(22) Filed: Dec. 19, 2014

(65) Prior Publication Data

US 2015/0184430 A1 Jul. 2, 2015

Related U.S. Application Data

(60) Provisional application No. 61/919,282, filed on Dec. 20, 2013.

(51) Int. Cl.

| | |
|---|---|
| ***E05C 3/06*** | (2006.01) |
| ***E05B 85/02*** | (2014.01) |
| ***E05B 77/38*** | (2014.01) |
| ***E05B 79/08*** | (2014.01) |
| ***E05B 81/34*** | (2014.01) |

(52) U.S. Cl.

CPC ..... *E05B 85/02* (2013.01); *E05B 77/38* (2013.01); *E05B 79/08* (2013.01); *E05B 81/34* (2013.01); *Y10T 29/4984* (2015.01); *Y10T 29/49826* (2015.01); *Y10T 292/1043* (2015.04); *Y10T 292/1082* (2015.04)

(58) Field of Classification Search

CPC ..... E05B 77/38; E05B 77/34; E05B 77/36; E05B 77/42; Y10T 292/688; Y10S 292/56

USPC ..... 292/201

See application file for complete search history.

(56) References Cited

U.S. PATENT DOCUMENTS

| | | | | |
|---|---|---|---|---|
| 4,165,112 A * | 8/1979 | Kleefeldt | E05B 85/045 | 292/216 |
| 4,186,952 A * | 2/1980 | Glass | E05C 3/042 | 292/202 |
| 4,679,836 A * | 7/1987 | Pupillo | E05B 85/243 | 292/216 |
| 4,727,301 A * | 2/1988 | Fulks | E05B 81/25 | 292/DIG. 23 |
| 5,106,134 A * | 4/1992 | Thau | E05B 85/045 | 292/216 |
| 7,246,840 B2 * | 7/2007 | Gates | B60J 1/1884 | 292/341.15 |

(Continued)

FOREIGN PATENT DOCUMENTS

EP 1621705 A2 2/2006

OTHER PUBLICATIONS

European Search Report for Application No. EP 14 19 9589.

*Primary Examiner* — Mark Williams
(74) *Attorney, Agent, or Firm* — Cantor Colburn LLP

(57) ABSTRACT

A latch is provided including a buffer, a latch housing, and an actuator housing coupled to the latch housing. The buffer includes a center portion and a first side portion. The actuator housing includes a cavity having a first opening. The cavity is configured to receive the buffer. When the buffer is installed in the cavity, the center portion of the buffer abuts an interior surface of the cavity and the first side portion of the buffer extends through the first opening into a hollow interior of the actuator housing.

13 Claims, 5 Drawing Sheets

(56) References Cited

U.S. PATENT DOCUMENTS

| | | | | |
|---|---|---|---|---|
| 2002/0036409 | A1* | 3/2002 | Lambertz | E05B 77/42 292/336.3 |
| 2004/0004358 | A1* | 1/2004 | Arlt | E05B 77/34 292/235 |
| 2008/0303292 | A1* | 12/2008 | Graute | E05B 77/38 292/216 |
| 2012/0126550 | A1* | 5/2012 | Patel | E05B 77/38 292/195 |
| 2012/0161455 | A1* | 6/2012 | Meyer | E05B 85/26 292/219 |
| 2013/0160538 | A1 | 6/2013 | Taurasi | |
| 2013/0270840 | A1 | 10/2013 | Lujan et al. | |
| 2016/0208521 | A1* | 7/2016 | Weichsel | E05B 79/20 |

* cited by examiner

LATCH BUFFER ASSEMBLY

CROSS REFERENCE TO RELATED APPLICATIONS

This application claims the benefit of U.S. Provisional Patent Application Ser. No. 61/919,282 filed Dec. 20, 2013, the entire contents of which are incorporated herein by reference thereto.

TECHNICAL FIELD

Exemplary embodiments of the present invention relate generally to latch mechanisms and, more particularly, to latch mechanisms including a buffer.

BACKGROUND

Latch systems are well known in the art. Typically, a component, such as a vehicle door for example, will have a latch for engaging and cinching onto a striker. The latch will have a rotatably mounted fork bolt or claw and a detent or pawl engaged with the claw. The claw cooperates with a mouth of a latch housing to pivot between an open and closed position for receiving, engaging, and cinching a striker. As the claw engages the striker, the claw rotates and the pawl travels along a cam surface of the claw to retain the claw in a closed and cinched position. Inner and outer manually movable release handles may be operably connected to inner and outer release levers on the latch. To release the latch, the pawl is rotated by responsive movement of either of the inner or outer release levers to disengage the claw.

Movement of the claw, pawl, the inner or outer release lever, or another component of the latch may also be operated via an actuator. In conventional latches, a buffer is often mounted to the housing, near the actuator, and is configured to contact a stopper portion of the actuator. Thus, the buffer limits an amount of movement of the actuator, and therefore the mount of movement of a component coupled to the actuator. The buffer is positioned within a bore in the housing. During operation, the buffer may be dislodged from the housing and interfere with the movement of the other components of the latch. Once the buffer has fallen inside the latch, the buffer cannot be easily accessed without dismantling a significant portion of the latch.

Accordingly, it is desirable to provide a latch wherein unintended movement of the buffer relative to the housing is prevented from occurring.

SUMMARY OF THE INVENTION

In accordance with an exemplary embodiment of the present invention, a latch is provided including a buffer, a latch housing, and an actuator housing coupled to the latch housing. The buffer includes a center portion and a first side portion. The actuator housing includes a cavity having a first opening. The cavity is configured to receive the buffer. When the buffer is installed in the cavity, the center portion of the buffer abuts an interior surface of the cavity and the first side portion of the buffer extends through the first opening into a hollow interior of the actuator housing.

In accordance with another embodiment of the present invention, a method of installing a buffer into an actuator housing is provided including inserting the buffer into a cavity formed in an exterior surface of the actuator housing. When inserted, a center portion of the buffer abuts an interior surface of the cavity and a first side portion of the buffer extends through a first opening of the cavity into a hollow interior of the actuator housing.

The above-described and other features and advantages of the present invention will be appreciated and understood by those skilled in the art from the following detailed description, drawings, and appended claims.

BRIEF DESCRIPTION OF THE DRAWINGS

Embodiments of the present invention will now be described, by way of example only, with reference to the accompanying drawings in which.

DETAILED DESCRIPTION

Figure 1:
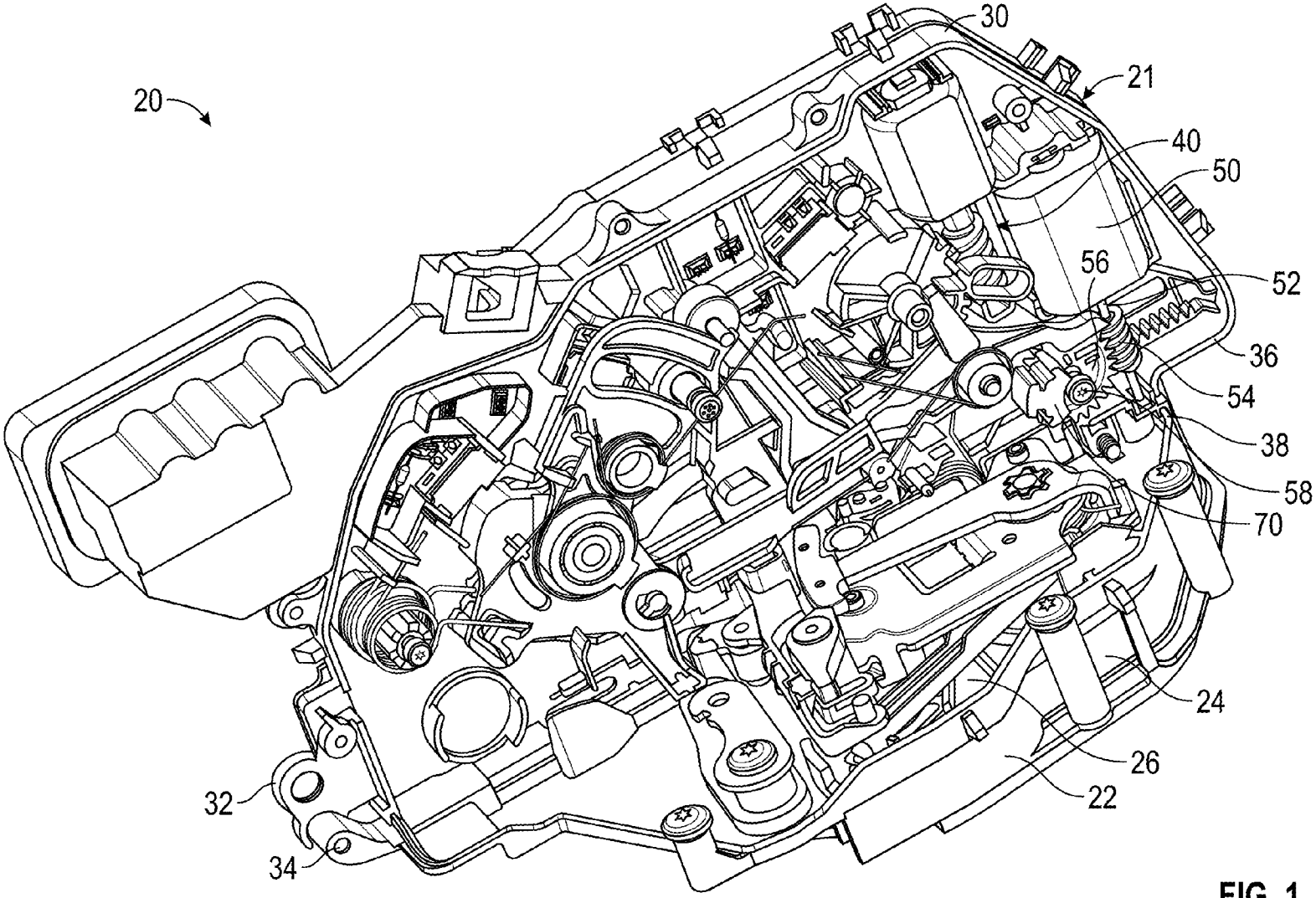
FIG. 1 is a perspective view of an interior of a latch assembly according to an embodiment of the invention.

With reference to the FIGS. a latch or latch assembly 20 is illustrated. The latch 20 includes a latch body 22 that may be integrated into a component of a vehicle (not shown), such as the vehicle structure adjacent a door, lift gate, or trunk for example. The latch body 22 includes a metallic or plastic latch housing 24, fixed to the component of a vehicle, and including a generally hollow interior 26. Arranged within the hollow interior 26 of the latch housing 24 is a plurality of conventional latch components, such as a fork bolt or claw, a detent or pawl, and a release lever (not shown) for example, which may be used to retain and release an adjacent component of the vehicle.

The latch 20 also includes an actuator 21 having an actuator housing 30, which in one non-limiting embodiment may comprise two portions secured to each other or an actuator housing 30 with an actuator housing cover 31 secured thereto. The actuator 21 is operatively coupled to the latch such that actuation of the actuator 21 will cause a desired movement of a component of the latch 20 in the latch housing 24 and/or actuator housing 30. The housing 30 is fixed to the latch housing 24 in any suitable manner by, for example in a generally perpendicular orientation as illustrated in FIG. 1. In one embodiment, a first end 32 of the actuator housing 30 and the latch housing 24 is coupled with a pin 34, and a second end 36 of the actuator housing 30 includes an opening (not shown) configured to receive a complementary portion of an adjacent wall 38 of the latch housing 24. As mentioned above, an actuator housing 31 is provided to cover the interior of the actuator components located in the actuator housing 30. Actuator housing cover 31 is configured to be secured to actuator housing 30. In one non-limiting embodiment, the actuator housing 31 may be configured to cover latch housing 24 as well as actuator housing 30. The actuator housing 30 as well as the actuator housing cover 31 may also include a metallic or plastic material and may be formed from the same material or a different material than the latch housing 24. Similar to the latch housing 24, the actuator housing 30 defines a generally hollow interior 40 configured to support and a plurality of components. In the illustrated embodiment, a motor 50 including a rotatable shaft 52 is arranged within a cavity (not shown) formed in the hollow interior 40 of the actuator housing 30. A worm gear 54 mounted concentrically to the motor shaft 52 is configured to rotate with the shaft 52 in either a first direction or a second, opposite direction. A worm wheel 56, mounted to the actuator housing 30 with a support shaft 58, is positioned adjacent to and meshed with the worm gear 54. As a result, operation of the motor 50 causes the worm gear 54 to engage and rotate the worm wheel 56 in either a clockwise or counter clockwise directions depending upon the direction in which shaft 52 is rotated or alternatively as other components operatively coupled to worm wheel 56 are moved with respect to the latch 20.

Figure 2:
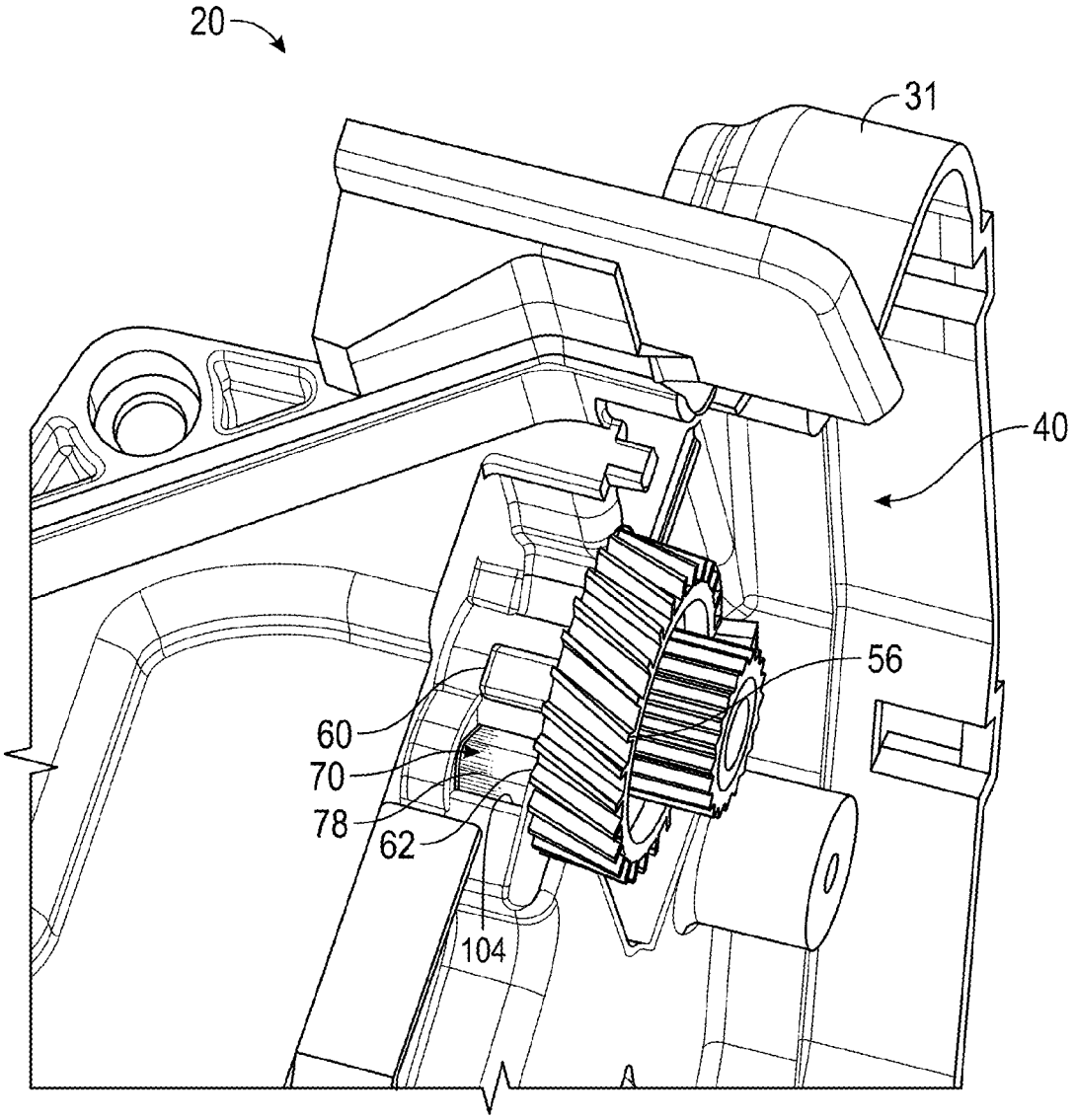
FIG. 2 is a perspective view of an interior portion of an actuator housing or housing cover of the latch assembly according to an embodiment of the invention.

A stop feature 60 (FIG. 2) such as a rectangular or cylindrical protrusion extends from the planar surface 62 of the worm wheel 56, generally in the direction of the actuator housing 30. The stop feature 60 is configured to contact a buffer 70 mounted to the actuator housing 30 adjacent the support shaft 58 of the worm wheel 56. When the worm wheel 56 rotates in a first direction, the stop feature 60 is configured to contact a first side of the buffer 70, and when the worm wheel 56 rotates in a second, opposite direction, the stop feature 60 is configured to contact a second side of the buffer 70.

Figure 3:
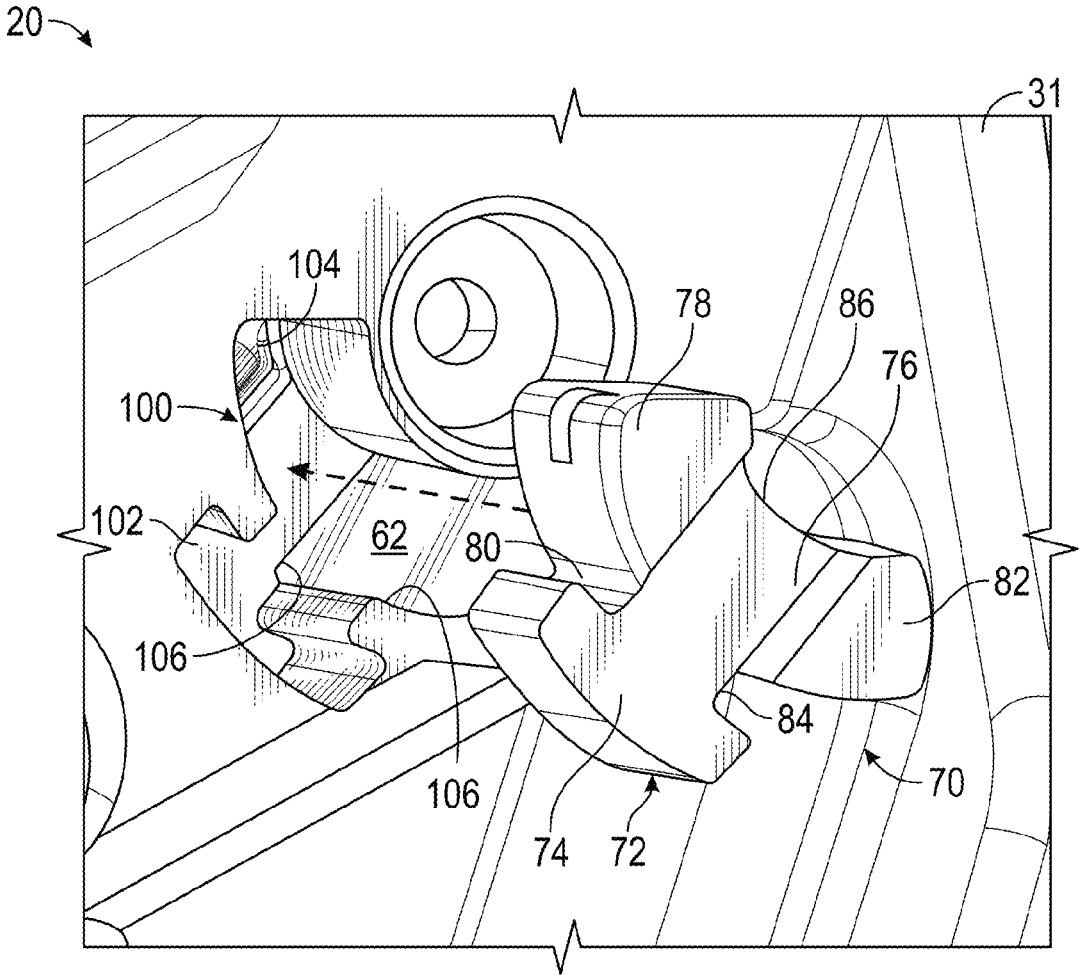
FIG. 3 is a perspective view of a portion of an exterior of the actuator housing or actuator housing cover of the latch assembly according to an embodiment of the invention.
Figure 4A:
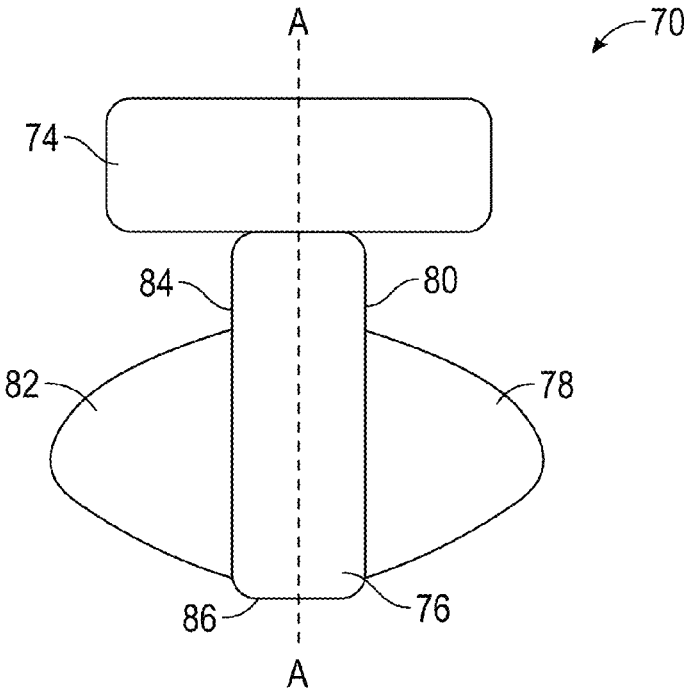
FIG. 4A is a side view of a buffer of the latch assembly according to one non-limiting embodiment of the invention.
Figure 4B:
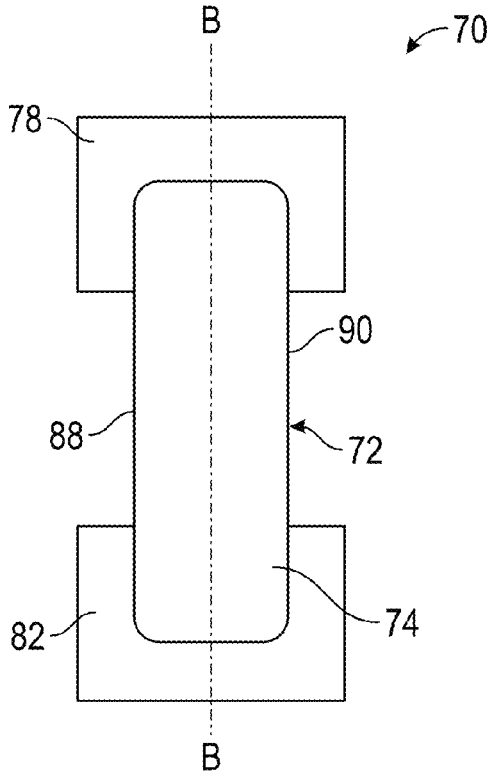
FIG. 4B is a top view of a buffer of the latch assembly according to one non-limiting embodiment of the invention.
Figure 5:
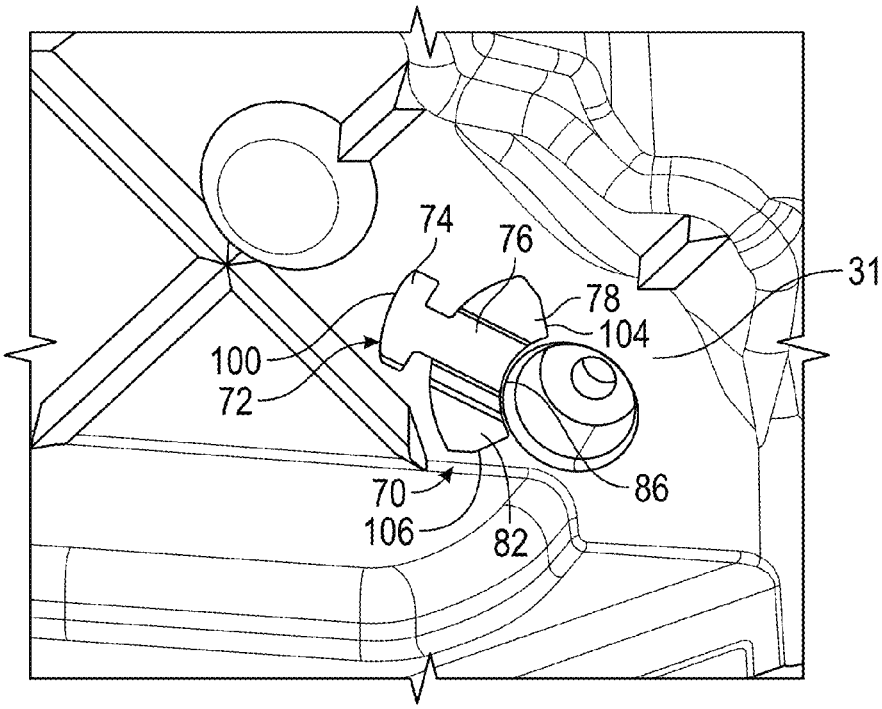
FIG. 5 is a perspective view of the exterior of the actuator housing or housing cover of the latch assembly with the buffer installed according to an embodiment of the invention.
Figure 6:
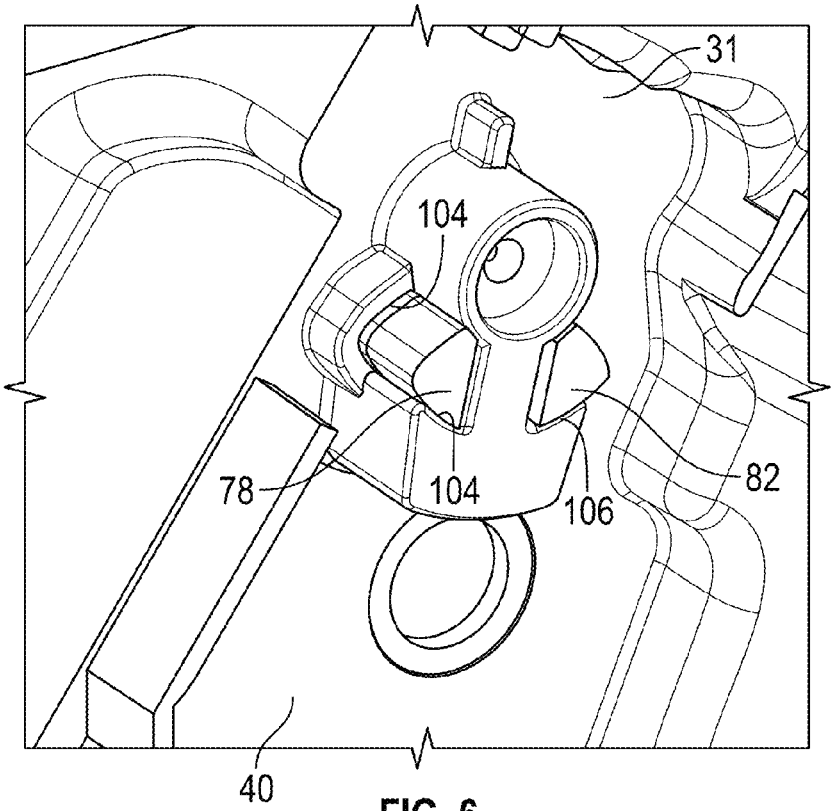
FIG. 6 is a perspective view of the interior of the actuator housing or housing cover of the latch assembly with the buffer installed according to an embodiment of the invention.

Referring now to FIGS. 3-5, the buffer 70 of the latch 20 is illustrated in more detail. The buffer 70 is formed from a hard elastic or plastic material, such as rubber or any other suitable elastomeric material configured to adsorb contact forces from stop feature 60. In one embodiment, buffer 70 includes a center portion 72 having an integrally formed head 74 and base 76 oriented generally perpendicular to one another to form a T-shape. A first side portion 78, configured to contact the stop feature 60 when the worm wheel 56 rotates in a first direction, extends from a first side 80 of the base 76. Similarly, an identical, second side portion 82, configured to be contact the stop feature 60 when the worm wheel 56 rotates in a second direction, extends from a second side 84 of the base 76 such that the buffer 70 is substantially symmetrical about a center plane A generally parallel to the sides 80, 84 of the base 76. In one embodiment, the first and second side portions 78, 82 are positioned adjacent the end 86 of the base 76, opposite the head 74. The shape and contour of the side portions 78, 82 may be selected based on the geometry of the worm wheel 56 and to facilitate engagement between the stop feature 60 and each side portion 78, 82. Although the first and second side portions 78, 82 are described separately, embodiments where the first and second side portions 78, 82 are formed as a single piece are considered to be within the scope of various embodiments of the present invention.

In one embodiment, the first and second side portions 78, 82 are integrally formed with the base 76 of the center portion 72. As illustrated in FIG. 4*b*, the first and second side portions 78, 82 extend in at least a first direction beyond a planar surface 88 of the center portion 72. The first and second side portions 78, 82 may additionally extend in a second direction beyond an opposite planar surface 90 of the center portion 72 such that the buffer 70 is symmetrical about a central plane B, oriented parallel to the planar surfaces 88, 90 of the center portion 72. Although a specific configuration of the buffer 70 is illustrated and described herein buffers 70 having other geometries and configurations are within the scope of the invention.

The actuator housing 30 or housing cover 31 includes a cavity 100 configured to receive and retain the buffer 70 therein. In one embodiment, the cavity 100 is positioned such that when the buffer 70 is inserted into the cavity 100, end 86 of the center portion 72 is generally adjacent the portion of the actuator housing 30 or housing cover 31 in which the pin 58 configured to support the worm wheel 56 is mounted. The shape of the cavity 100 is similar to at least a portion of the buffer 70 such that a portion or portions of the buffer 70 are retained in the cavity 100 due to an interference fit with portions of the buffer 70 when they are received within the cavity 100. An interior surface 102 and the shape of the cavity 100 limits movement of the buffer 70 relative to the actuator housing 30 or actuator housing cover 31. In particular, the interior surface 102 of the cavity 100 prevents the buffer 70 from falling from its installed position into the hollow interior 40 of the actuator housing 30 during operation of the latch 20 and/or installation of the buffer 70 to the latch 20. Moreover, the interior surface 102 and the configuration of the buffer 70 prevent it from being completely inserted into the hollow interior 40 of the actuator housing 30 or actuator housing cover 31 when the buffer 70 is inserted or installed from an outside of the actuator housing 30 or actuator housing cover 31. In other words, the buffer 70 and the cavity 100 of the actuator housing 30 or actuator housing cover 31 are configured such that the buffer 70 can only be installed from an exterior of the actuator housing 30 or actuator housing cover 31 such that should the buffer 70 become dislodged or removed from the latch 20 it will not be able to fall into the interior of the latch 20 and disrupt operation of components of the latch 20 and/or operation of the latch 20 itself. In addition, the buffer 70 and the cavity 100 of the actuator housing 30 or actuator housing cover 31 are configured such that during installation of the buffer 70 into cavity 100, the buffer 70 cannot be accidentally pushed into the hollow interior 40 of the actuator housing 30 or actuator housing cover 31 of the latch 20 when they are secured to each other and the buffer 70 is installed into the actuator housing 30 or actuator housing cover 31 of the latch 20. See for example, FIG. 3 which shows the buffer 70 being inserted into cavity 100 in the direction of the arrow with dashed lines. Although and in one embodiment, the cavity 100 is illustrated in actuator cover 31, it is understood that the cavity may be located in anyone of the actuator housing 30, actuator cover 31, latch housing 24 and its associated cover which may or may not be integral with actuator cover 31 or any other desired location. Moreover, multiple cavities and buffers (e.g., more than one) for multiple components may be employed in alternative embodiments of the present invention. Alternatively, only a single cavity 100 and buffer 70 may be employed.

In one embodiment, the cavity 100 includes a first opening 104 and a second opening 106 extending through the actuator housing 30. Each of the first opening 104 and the second opening 106 are configured to receive a portion of the buffer 70, for example the first and second side portions 78, 82, respectively. The position of the openings 104, 106 relative to the cavity 100 is determined by the portion of the buffer 70 that each opening 104, 106 is configured to receive. In the illustrated non-limiting embodiment, the first opening 104 and the second opening 106 are arranged adjacent opposing sides of the cavity 100, in a position complementary to the first and second side 78, 82 portions of the buffer 70. When the buffer 70 is installed in the actuator housing cover 31, the planar surface 88 of the center portion 72 of the buffer 70 contacts the interior surface 102 of the cavity 100 and the side portions 78, 82 of the buffer 70 extend through the openings 104, 106. In one embodiment, the interior surface 102 of the cavity 100 is configured to cover the planar surface 88 of the center portion 72. The side portions 78, 82 are exposed within the hollow interior 40 of the actuator housing 30 to contact the stop feature 60 of the adjacent the worm wheel 56 as it rotates.

The actuator housing 30 and actuator housing cover 31 described herein allows for easy installation of the buffer 70 into the cavity 100 only from the outside of the actuator housing 30 or housing cover 31. The complementary contour of the buffer 70 and the cavity 100, as well as the interior surface 102 of the cavity 100, prevents dislocation of the buffer 70 into the latch 20 or actuator during installation of the buffer 70 as well as during operation of the latch 20 and/or the actuator of the latch.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A latch comprising:

a buffer including a center portion, a first side portion, and at least one outer side comprising a first side and a second side, the outer side extending along an outer perimeter of the buffer;

a latch housing;

an actuator housing coupled to the latch housing, the actuator housing including a cavity having a first opening, the buffer disposed within the cavity, the outer surface of the buffer abutting an interior surface of the cavity in an interference fit condition, the first side portion of the buffer extending through the first opening into a hollow interior of the actuator housing, wherein the buffer and the cavity are configured such that the buffer can only be inserted into the cavity from an exterior of the actuator housing such that the buffer cannot completely pass through the first opening and into the hollow interior of the actuator housing;

an actuator disposed within the actuator housing; and at least one latch component driven by the actuator, the at least one latch component comprising at least one of a claw and a pawl.

2. The latch according to claim 1, wherein a contour of the cavity is generally complementary to the buffer.

3. The latch according to claim 1, further comprising:

a motor mounted within the hollow interior of the actuator housing;

a movable component operably coupled to the motor such that operation of the motor causes the movable component to move in either a first direction or a second direction, opposite the first direction, the movable component including a stop feature.

4. The latch according to claim 3, wherein the first side portion of the buffer is configured to contact the stop feature of the movable component to limit rotation of the movable component in the first direction.

5. The latch according to claim 4, wherein the cavity further comprises a second opening.

6. The latch according to claim 5, wherein the buffer includes a second side portion and when the buffer is installed in the cavity of the actuator housing, the second side portion of the buffer extends through the second opening into the hollow interior of the actuator housing.

7. The latch according to claim 6, wherein the second side portion of the buffer is configured to contact the stop feature of the movable component to limit rotation of the movable component in the second direction.

8. The latch according to claim 7, wherein the first side portion is mounted to a first side of the center portion and the second side portion is mounted to a second side of the center portion.

9. The latch according to claim 8, wherein the first side portion and the second side portion are similar such that the buffer is symmetrical about a center plane parallel to the first side and second side of the center portion.

10. The latch according to claim 4, wherein the first side portion extends beyond a first planar surface of the moveable component and a second planar surface of the moveable component, opposite the first planar surface of the center portion of the buffer.

11. The latch according to claim 10, wherein the buffer is generally symmetrical about a center plane parallel to the first planar surface and the second planar surface of the center portion of the buffer.

12. The latch according to claim 10, wherein the interior surface of the cavity is configured to extend over the first planar surface of the center portion of the buffer.

13. The latch as in claim 1, wherein the cavity is located in a housing cover of the actuator housing.

* * * * *